US009285080B2

(12) United States Patent
Fan et al.

(10) Patent No.: US 9,285,080 B2
(45) Date of Patent: Mar. 15, 2016

(54) COMPOSITION AND METHOD FOR REDUCING HYDROCARBON FRICTION AND DRAG IN PIPELINE FLOW

(71) Applicant: GREEN SOURCE ENERGY LLC, Austin, TX (US)

(72) Inventors: Liang-tseng Fan, Manhattan, KS (US); Shahram Reza Shafie, Austin, TX (US)

(73) Assignee: Green Source Holdings, LLC, Austin, TX (US)

( * ) Notice: Subject to any disclaimer, the term of this patent is extended or adjusted under 35 U.S.C. 154(b) by 274 days.

(21) Appl. No.: 13/904,764

(22) Filed: May 29, 2013

(65) Prior Publication Data

US 2013/0333766 A1 Dec. 19, 2013

Related U.S. Application Data

(60) Provisional application No. 61/653,088, filed on May 30, 2012.

(51) Int. Cl.

| | |
|---|---|
| ***F17D 1/17*** | (2006.01) |
| ***C10M 105/02*** | (2006.01) |
| ***C10M 105/08*** | (2006.01) |

(52) U.S. Cl.

CPC ..... *F17D 1/17* (2013.01); *C10M 2203/065* (2013.01); *C10M 2203/1006* (2013.01); *C10M 2207/022* (2013.01); *C10M 2207/0235* (2013.01); *C10M 2219/082* (2013.01); *Y10T 137/0391* (2015.04)

(58) Field of Classification Search

CPC ..... C10M 2203/065; C10M 2203/1006; C10M 2207/022; C10M 2207/0235; C10M 2219/082; Y10T 137/0391; F17D 1/17

USPC ..... 508/110; 507/203

See application file for complete search history.

(56) References Cited

U.S. PATENT DOCUMENTS

| | | | | |
|---|---|---|---|---|
| 4,573,488 | A * | 3/1986 | Carville et al. | 137/13 |
| 7,037,955 | B2 * | 5/2006 | Timcik et al. | 523/102 |
| 2009/0078612 | A1 | 3/2009 | Fan et al. | |
| 2009/0250381 | A1 * | 10/2009 | Fan et al. | 208/390 |
| 2011/0114323 | A1 | 5/2011 | Jennings et al. | |
| 2012/0035085 | A1 * | 2/2012 | Parnell et al. | 507/213 |

FOREIGN PATENT DOCUMENTS

WO 2010/104516 A1 9/2010

OTHER PUBLICATIONS

International Search Report and Written Opinion issued in International Application No. PCT/US2013/042028 on Jul. 23, 2013, 10 pages.

* cited by examiner

*Primary Examiner* — James Goloboy

(74) *Attorney, Agent, or Firm* — Rothwell, Figg, Ernst & Manbeck, P.C.

(57) ABSTRACT

A method and composition for reducing drag, reducing friction, reducing viscosity, and/or improving flow of viscous hydrocarbons including adding an effective amount of a drag-reducing composition containing a blend of turpentine liquids to a viscous hydrocarbon storage or pipeline operation and forming a drag-reducing mixture of viscous hydrocarbons and the blend of turpentine liquids.

35 Claims, 8 Drawing Sheets

COMPOSITION AND METHOD FOR REDUCING HYDROCARBON FRICTION AND DRAG IN PIPELINE FLOW

CROSS REFERENCE TO RELATED APPLICATIONS

The present application claims benefit of U.S. Provisional Application No. 61/653,088, filed on May 30, 2012, all of which is incorporated herein by reference in its entirety for all purposes.

FIELD OF THE INVENTION

The present disclosure relates to reducing drag, reducing friction, reducing viscosity, and/or improving flow of viscous hydrocarbons.

BACKGROUND OF THE INVENTION

Operations for recovering and transporting viscous hydrocarbons such as crude oil, bitumen and processed or semi-processed refinery products are faced with challenges in terms of high viscosity and high pressure drop due to fluid mechanic phenomena. Friction between the viscous fluid and the wall creates frictional pressure drop, i.e., drag, which reduces performance and flow in such operations. Increasing pumping power counteracts drag, but is disadvantageous because it requires larger pumping stations, expensive pumps, and adds energy costs.

Drag reduction is the increase in pumpability of a fluid and can be effected by the addition of a drag reducing additive to the fluid. At present, polymers are used as drag-reducing agents. For example, water-soluble long-chain hydrocarbon polymers have been effective in reducing horsepower requirements and/or increasing injection rates during treatments. Drag reducing additives used commercially are aqueous suspensions of polymers.

However, drag reduction has not been effectively implemented in the pipelining of large quantities of viscous hydrocarbons, such as crude oil, bitumen, kerogen, asphaltene, or tar. Notably, heavy crude oil has been a challenge for existing commercially available drag reducing agents.

Drag reducers that are currently being used by the oil industry have disadvantages because, during pipeline operations, the long-chain drag-reducing polymers easily degrade due to shear forces. This degradation reduces the efficiency of the pipeline and increases costs. In order to replace the degraded drag reducers, a fresh drag reducing agent must be added frequently in various sections of pipelines, such as pumping stations. Accordingly, there is a need for new, more stable, and improved drag reduction methods and compositions.

SUMMARY OF THE INVENTION

This disclosure relates to compositions and methods that have been found to surprisingly improve drag-reduction, reduction of friction and viscosity, and improve flow of viscous hydrocarbons. This disclosure describes methods and compositions that have unexpectedly been found to be resistant to degradation, even when tested with high shear rates.

In one embodiment, this disclosure provides a method of reducing drag, reducing friction, reducing viscosity, and/or improving flow of viscous hydrocarbons. The method can include the steps of introducing an effective amount of a drag-reducing composition containing a blend of turpentine liquids to a viscous hydrocarbon storage or pipeline operation and forming a drag-reducing mixture of viscous hydrocarbons and the blend of turpentine liquids is formed.

In another embodiment, the present invention provides a composition for reducing drag, reducing friction, reducing viscosity, and/or improving flow of viscous hydrocarbons that includes an amount of a blend of turpentine liquids that is effective for reducing drag, reducing friction, reducing viscosity, and/or improving flow of viscous hydrocarbon through a viscous hydrocarbon storage and/or pipeline operation.

BRIEF DESCRIPTION OF THE DRAWINGS

FIG. 3 shows a comparison of viscosities of all three samples using a straight die as well as a 90° elbow die. Viscosities of all samples were measured in the shear rate range which gave the Reynolds number in the range of 1,500-4,000 for respective samples.

DETAILED DESCRIPTION OF THE INVENTION

Figure 1:
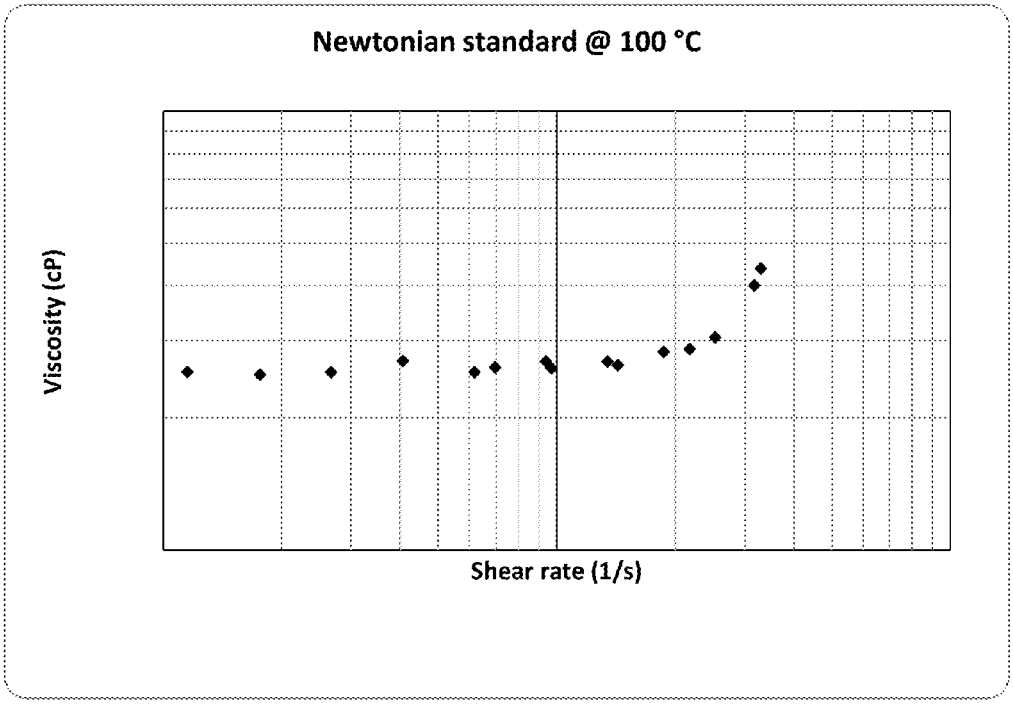
FIG. 1 shows the steady shear viscosity data of the standard oil at 100° C. with a straight die. The viscosity profile shows a steep upturn at higher shear rates due to secondary flows.
Figure 2:
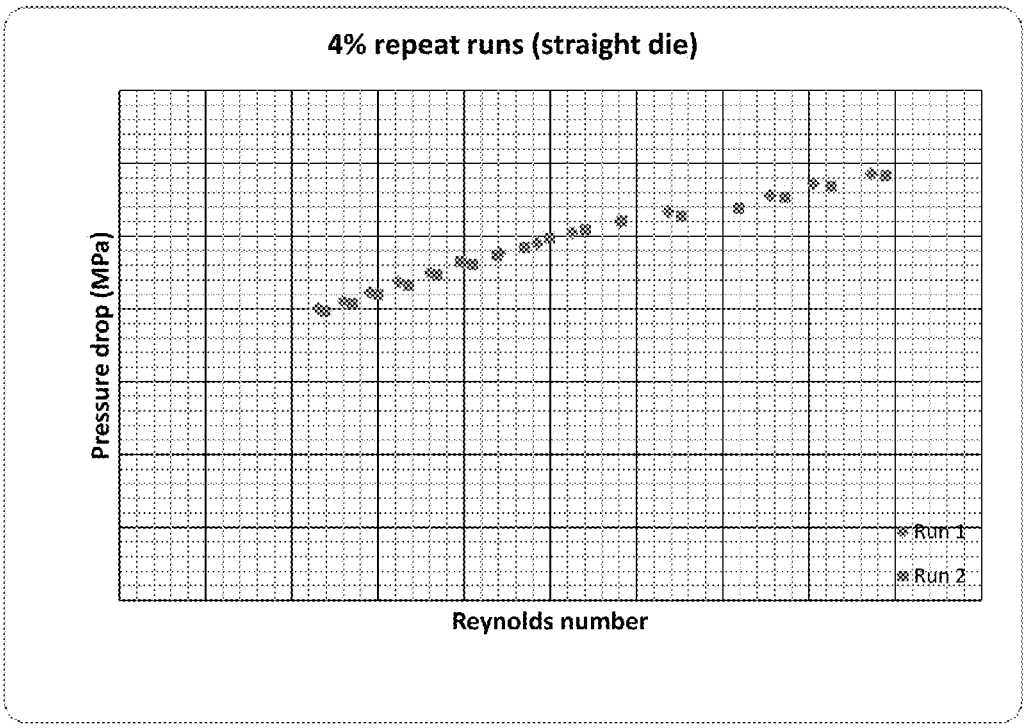
FIG. 2 presents pressure drop profiles for the filtered crude oil sample containing 4% of the blend of turpentine liquids at 100° C. in the Reynolds number in the range of 1,200-4,400. Excellent reproducibility was observed.

This disclosure relates to compositions and methods for reducing drag, reducing friction, reducing viscosity, and/or improving flow of viscous hydrocarbons. The methods and compositions of the present disclosure take advantage of low-toxicity, low-volatility, recoverable, and mass-producible turpentine liquids. These turpentine liquids are recyclable, and thus, are appreciably less expensive and/or more suitable than any other known drag reducing agent such as polymers. Particularly effective blends of these turpentine liquids have been developed according to the compositions of this disclosure and for use in the methods of this disclosure.

Various viscous hydrocarbon conduits can be treated with the compositions of this disclosure. The compositions and methods of this disclosure are especially useful for use in operations of chemical refineries, petrochemical plants, viscous hydrocarbon storage facilities, as well as pipeline to tank farm operations. The compositions and methods of this disclosure reduce frictional pressure during fluid flow in a conduit or pipeline.

As used herein, "viscous hydrocarbons" include light, medium, and heavy crude oils, bitumen, tar, asphalt, asphaltene, kerogen, processed or semi-processed refinery products, diesel, light cycle oil, lube cut base oil, mineral oil, vacuum gas oil, middle distillate, kerosene, vacuum tower bottom product, heavy residues at oil refineries, crude oil tank bottoms, or a combination thereof. In some embodiments, the "viscous hydrocarbons" are a fluid originating from a subterranean formation.

In one embodiment, this disclosure provides a composition that reduces drag, reduces friction, reduces viscosity, and/or improves flow of viscous hydrocarbons that includes an amount of a blend of turpentine liquids that is effective for reducing drag, reducing friction, reducing viscosity, and/or improving flow of viscous hydrocarbons through a viscous hydrocarbon storage and/or pipeline operation.

The blend of turpentine liquids can be made from two or more turpentine liquids. Turpentine liquids include natural turpentine, synthetic turpentine, mineral turpentine, pine oil, alpha-pinene, beta-pinene, alpha-terpineol, beta-terpineol, gamma-terpineol, 3-carene, anethole, dipentene (p-mentha-1,8-diene), terpene resins, alpha-terpene, beta-terpene, gamma terpene, nopol, pinane, camphene, p-cymene, anisaldehyde, 2-pinane hydroperoxide, 3,7-dimethyl-1,6-octadiene, isobornyl acetate, terpin hydrate, ocimene, 2-pinanol, dihydromyrcenol, isoborneol, alloocimene, alloocimene alcohols, geraniol, 2-methoxy-2,6-dimethyl-7,8-epoxyoctane, camphor, p-menthan-8-ol, alpha-terpinyl acetate, citral, citronellol, 7-methoxydihydrocitronellal, 10-camphorsulphonic acid, p-menthene, p-menthan-8-yl acetate, citronellal, 7-hydroxydihydrocitronellal, menthol, menthone, or polymers thereof.

In some embodiments, the composition includes a second liquid added to the blend of turpentine liquids. According to certain embodiments, the second liquid can be selected from lower aliphatic alcohols, alkanes, aromatics, aliphatic amines, aromatic amines, carbon bisulfide and mixtures thereof. Exemplary mixtures include solvents manufactured in petroleum refining, such as decant oil, light cycle oil and naphtha, or solvents manufactured in dry distilling coal and fractionating liquefied coal. In some embodiments, ethylene glycol is added to the composition. In certain embodiments, a drag reducing polymer can be used in combination with the composition of this disclosure. In some embodiments, at least one of drag reducing agents, anti-freezing agents, and corrosion inhibitors can be used in combination with the composition of this disclosure.

As used herein "the second liquid" includes one or more liquids that are added to the blend of turpentine liquids.

In certain embodiments, the composition consists essentially of a blend of turpentine liquids and the second liquid.

The drag-reducing composition is said to consist essentially of the blend of turpentine liquids and the second liquid if the blend of turpentine liquids and the second liquid are the essential active ingredients for substantially all of the drag-reduction and the other ingredients in the composition are essentially inactive or non-active in drag-reduction.

As used herein, the term "non-active" shall mean that the ingredient is not present in an effective active amount for drag-reduction.

As used herein, the term "lower aliphatic alcohols" refers to primary, secondary and tertiary monohydric and polyhydric alcohols of between 2 and 12 carbon atoms. As used herein, the term "alkanes" refers to straight chain and branched chain alkanes of between 5 and 22 carbon atoms. Organic or inorganic solvents for use in some embodiments of the composition of this disclosure include, for example, benzene, toluene, hexane and xylene, or mixtures thereof.

In certain embodiments, the composition may contain a liquid selected from alkanes, aromatics, aliphatic amines, aromatic amines, carbon bisulfide, vegetable oils, solvents manufactured in petroleum refining, dry distilling coal, fractionating liquefied coal, and fractionating extracted hydrocarbons from oil (tar) sands and oil shale, or a mixture thereof.

In one embodiment, the blend of turpentine liquids includes α-terpineol, β-terpineol, β-pinene, and p-cymene. In one embodiment, the composition includes at least about 30% α-terpineol, and at least about 15% β-terpineol. In another embodiment, the blend of turpentine liquids includes about 40-60% α-terpineol, about 30-40% β-terpineol, about 5-20% β-pinene, and about 0-10% p-cymene. In another embodiment, the blend of turpentine liquids includes about 50% α-terpineol, about 35% β-terpineol, about 10% β-pinene, and about 5% p-cymene. In an alternative embodiment, a blend of turpentine liquids includes about 40-60% α-terpineol, about 30-40% α-pinene, about 5-20% β-pinene, and about 0-10% p-cymene or 40-60% α-terpineol, about 0-10% α-pinene, about 5-20% β-pinene, and about 30-40% p-cymene. In another embodiment, a blend of turpentine liquids includes about 50% α-terpineol, about 35% α-pinene, about 10% β-pinene, and about 5% p-cymene.

In certain embodiments, the amount of the blend of turpentine liquids added to the viscous hydrocarbons is in a range of about 1 ppm and about 10,000 ppm, 20,000 ppm, 40,000 ppm, 50,000 ppm, or 100,000 ppm, or in a range of about 10 ppm and about 10,000 ppm, or about 50 ppm and about 1,000 ppm. In another embodiment the ratio of the blend of turpentine liquids to the viscous hydrocarbons is in a range of about 50 ppm and about 500 ppm. Preferably, about 100 ppm of the turpentine liquid is used.

In some embodiments, the composition is substantially free of plasticizing agents.

In some embodiments, the composition is substantially free of surface active agent.

In some embodiments, the composition is substantially surfactant-free or surfactant-free.

In some embodiments, the composition is a homogeneous one phase liquid.

In certain embodiments, the composition is substantially non-aqueous or non-aqueous. In some embodiments, the composition is not an emulsion and an emulsion is not formed using the composition. In some embodiments, the composition is not a suspension and a suspension is not formed using the composition.

In certain embodiments, the drag-reducing composition can be used at a temperature within the range between about −5° C. to about 120° C., about 10° C. to about 120° C., or about 15° C. to about 75° C. In certain embodiments, the viscous hydrocarbon liquid is contacted with the composition at a temperature of less than about 100° C., less than about 70° C., less than 30° C., or at ambient temperature.

The present invention avoids the environmental, economic, and practical disadvantages that have plagued prior drag-reducing and hydrocarbon-transport techniques. To date, chemical and mechanical methods have been used with varying degrees of success. However, each of the known drag-reducing formulations may have certain drawbacks that one or more embodiments of the current invention overcome. In one embodiment, the renewable and "green" drag-reducing liquids of the present invention are naturally derived and free of carcinogenic and pollutant chemicals. Further, the use of the drag-reducing composition of the present disclosure for viscous hydrocarbon storage and pipeline operations avoids the economic and environmental costs associated with known viscous hydrocarbon transportation techniques.

The drag reducing composition contains active drag-reducing ingredients that are effective to decrease hydrocarbon fluid viscosity and bring about a significant decrease in pressure drop in the shear rate ranges in pipelines.

In one embodiment, this disclosure provides a method of reducing drag, reducing friction, reducing viscosity, and/or improving flow of viscous hydrocarbons. The method can include the steps of, in a viscous hydrocarbons storage and/or pipeline operation, adding an effective amount of a drag-reducing composition containing a blend of turpentine liquids, so as to form a drag-reducing mixture of viscous hydrocarbons and the blend of turpentine liquids. In some embodiments, the composition added according to the method also includes the second liquid.

In some embodiments, the viscosity of the drag-reducing mixture is reduced compared to the viscosity of the liquid hydrocarbon prior to treatment with the drag reducing composition. For example, the viscosity may be reduced by at least about 3%. In some embodiments, the viscosity is reduced by at least about 5-30%.

The method can be employed before start-up of pipeline operations, during ongoing pipeline or storage operations, during pumping operations, during maintenance of pipelines, pumping stations, or storage facilities, or during any shut down or start-up of a pipeline.

In certain embodiments, the method involves adding to a viscous hydrocarbon storage and/or pipeline operation, a composition that comprises, consists essentially of, or consists of a blend of turpentine liquids and the second liquid.

In certain embodiments, the method involves adding to a viscous hydrocarbon storage and/or pipeline operation, a composition that is substantially free of plasticizing agents. In some embodiments, the method does not include adding one or more plasticizing agents.

In certain embodiments, the method involves adding to a viscous hydrocarbon storage and/or pipeline operation, a composition that is substantially free of surface active agent. In some embodiments, the method does not include adding one or more surface-active agents.

In certain embodiments, the method involves adding to a viscous hydrocarbon storage and/or pipeline operation, a composition that is substantially surfactant-free or surfactant-free. In some embodiments, the method does not include adding one or more surfactants.

In certain embodiments, the method involves adding to a viscous hydrocarbon storage and/or pipeline operation, a composition that is substantially non-aqueous or non-aqueous. In some embodiments, the method involves adding to a viscous hydrocarbon storage and/or pipeline operation, a composition that is not an emulsion and an emulsion is not formed in the method.

In certain embodiments, the method involves adding to a viscous hydrocarbon storage and/or pipeline operation, a composition that is a homogeneous one phase liquid.

In some embodiments, the amount of the composition added is an amount effective to reduce drag, reduce viscosity, reduce pressure, and/or improve flow of the viscous hydrocarbon. In some embodiments, the composition of this disclosure is added in a ratio of about 0.001% to about 20% by weight of said viscous hydrocarbons. In certain embodiments, the composition of this disclosure is added in a ratio of about 0.01% to about 5% by weight of said viscous hydrocarbons. In certain embodiments, the composition is added such that the blend of turpentine liquids in the composition is about 0.001% to about 20% by weight of the viscous hydrocarbons, preferably between about 0.01% and about 5% by weight.

In certain embodiments, the viscous hydrocarbon is contacted with less than 5% of the blend of turpentine liquids. For example, in certain embodiments, the blend of turpentine liquids can be added to the viscous hydrocarbons in an amount of only about 0.01% to 4% for effective drag reduction.

In certain embodiments, the ratio of the blend of turpentine liquids to any other drag-reducing additive contained in the composition is greater than or equal to about 1:1, in certain embodiments greater than or equal to about 9:4. In certain embodiments, the ratio is greater than or equal to about 3:1. In yet other embodiments, the ratio is greater than or equal to about 4:1.

Still other aspects and advantages of the present invention will become easily apparent by those skilled in the art from this description, wherein certain embodiments of the invention are shown and described simply by way of illustration of the best mode contemplated of carrying out the invention. As will be realized, the invention is capable of other and different embodiments, and its several details are capable of modifications in various obvious respects, without departing from the invention. Accordingly, the description is to be regarded as illustrative in nature and not as restrictive.

EXAMPLES

Experiments to test the drag-reducing properties according to the present disclosure were conducted on a RH2000 Dual Bore bench top capillary rheometer on a filtered crude sample. The dimensions of the two dies employed in this study were 0.139×79.75 mm. One die was maintained as a straight die while a 90° elbow was introduced into the geometry of the second die. The pressure drop when the crude oils pass through a 90° bent die is significantly higher than when they are passed through a straight die. The vertical length of the bent (90° die was 60 mm. The use of both dies shows the effect of a 90° elbow on the pressure drop profile of the samples. The system used a 206 MPa transducer for this study. This tests the samples at shear rates of up to 5,500,000 l/s, which is in the turbulent flow region. The three samples' pressure and viscosity profiles were measured in a capillary rheometry experiment at temperatures of 80° C. and 100° C. The samples were measured in the shear rate range 600,000 to 5,500,000 l/s, which encompassed Reynolds numbers in the range from 100 to 9,000. The samples were tested in the laminar (Re<2,100), transition (2,100<Re<4,000) and turbulent (Re>4,000) flow regions.

Capillary rheology measurements were conducted on the three samples: 1) crude oil without drag reducing additives; 2) crude oil containing 4% of a blend of turpentine liquids; and 3) crude oil containing 6% of a blend of turpentine liquids. The viscosity and pressure profiles were established for each sample. The blend contained α-terpineol, β-terpineol, β-pinene, and p-cymene.

Scoping studies of the samples established the following shear rate ranges: 1) crude oil only—1.6 to 2.2 million l/s; 2)

4% blend—1.3 to 1.9 million l/s; and 3) 6% blend—1.5 to 1.9 million l/s. This study revealed that the drag-reducing composition decreases the viscosity of the crude oil, and also produces a decrease in pressure drop during flow, indicating effective drag reducing properties. Viscosity and pressure profiles were also established for the three samples using a 90° bent die, and the data were compared to similar profiles acquired using straight dies. Results indicate that higher levels of turbulence occur at lower shear rates while using the bent die compared to the straight die. The extrudate from the bent die measurements was collected and rerun through the same 90° bent die in order to determine any structural changes in the additive due to high rates of deformation encountered during the first viscosity measurements. Results show that the structure is affected by high rates of deformation, indicated by higher pressure drop of the extrudate when compared to the respective original samples.

The pressure drop in the straight pipe using a 4% blend shows improvement ranging from 24% to 32% compare to the crude oil without any additives with the Reynolds number covering laminar, transitional and turbulent flow with the range from 1100 to 4400.

The pressure drop in the first 90° elbow pipe of the 4% blend shows improvement ranging from 13% to 16%, and sent the mixture through the second 90° elbow pipe shows the improvement of up to 16% compared to the crude oil without any additives with the Reynolds number covering laminar, transitional and turbulent flow with the range from 1300 to 4300.

The pressure drop in the straight pipe of the 6% blend shows improvement ranging from 27% to 34% compared to the crude oil without any additives with the Reynolds number covering laminar, transitional and turbulent flow with the range from 1400 to 4200.

The pressure drop in the first 90° elbow pipe of the 6% blend shows improvement ranging from 19% to 24%, and subsequently sending the mixture through the second 90° elbow pipe shows the improvement of up to 19% compared to the crude oil without any additives with the Reynolds number covering laminar, transitional and turbulent flow with the range from 1400 to 4500.

Figure 3:
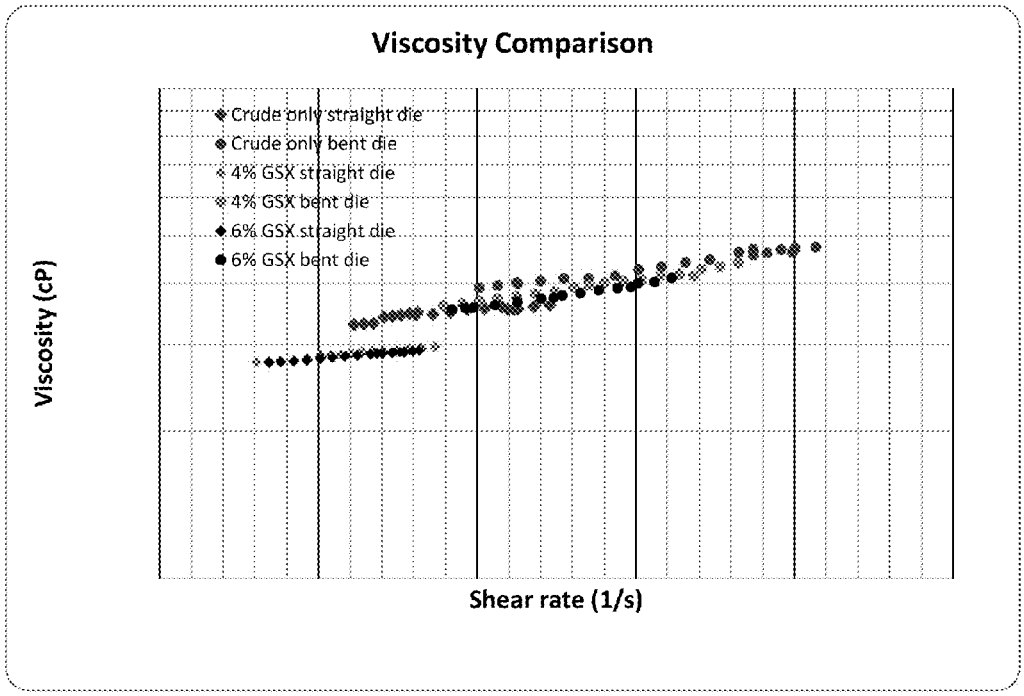
FIG. 3 presents a comparison of viscosity flow curves at 100° C. of all three (3) samples: Crude oil without drag reducers, crude oil containing 4% of the blend of turpentine liquids (labeled 4% GSX), and crude oil containing 6% of the blend of turpentine liquids (labeled 6% GSX).

FIG. 3 demonstrates that there is an increase in viscosity of samples measured using a 90° bent die compared to a straight die. Also the shear rates required to achieve the Reynolds numbers in the range of 1,500-4,000 are higher when using the bent die compared to the straight die. The viscosities of the 4% blend and 6% blend samples are distinctively lower than the viscosity of the crude oil without any drag reducing agents in the case of the straight die data. The viscosities of the 4% blend and 6% blend samples are very close to each other, which indicates that the difference in the blend loading from 4% to 6% does not have a significant effect on the viscosities of the samples. Rather, the testing indicates that similarly effective drag reduction can be obtained using lower percentages of the drag-reducing composition.

Figure 4:
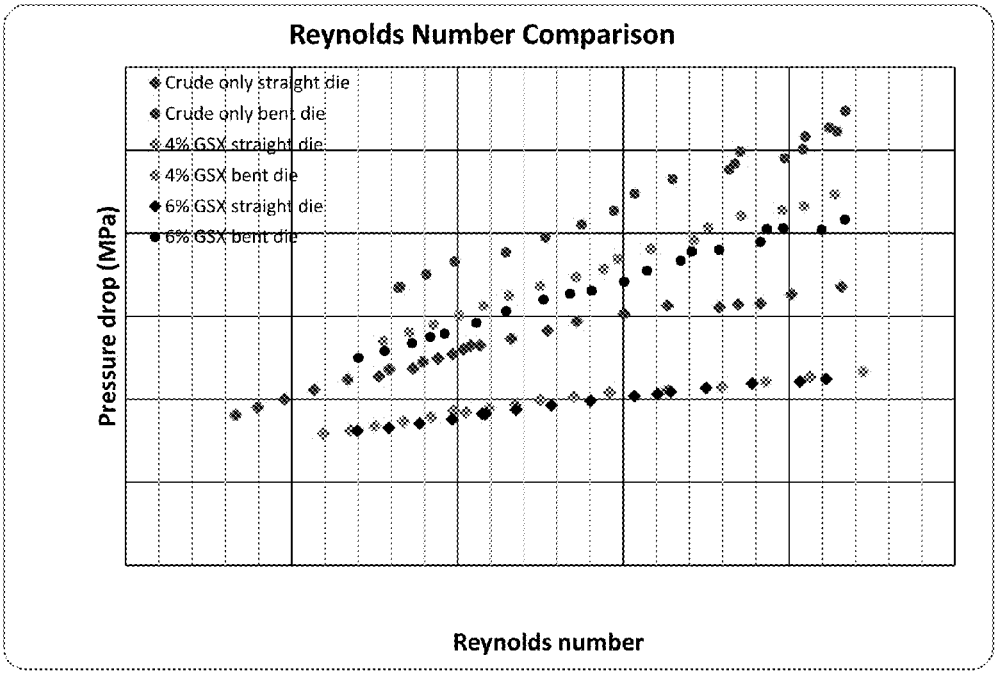
FIG. 4 compares the pressure drop profiles for the three samples at 100° C. and shows pressure drop profiles in the Reynolds number in the range of 1,500-4,000.

FIG. 4 indicates that the pressure drop decreases significantly for the 4% blend and 6% blend samples compared to the crude oil without any drag reducers. This phenomenon indicates that the drag reducing agents are effective in reducing the pressure drop, which is an indication that drag during flow is reduced. Also note that the pressure drop increases significantly for all three samples when a 90° elbow is introduced in the die, indicating higher turbulence levels. The figures also show that the drag reducing effect of the blend additive is slightly accentuated with increasing Reynolds number owing to the slope of the pressure profiles in the figure (straight die pressure profiles).

Figure 5:
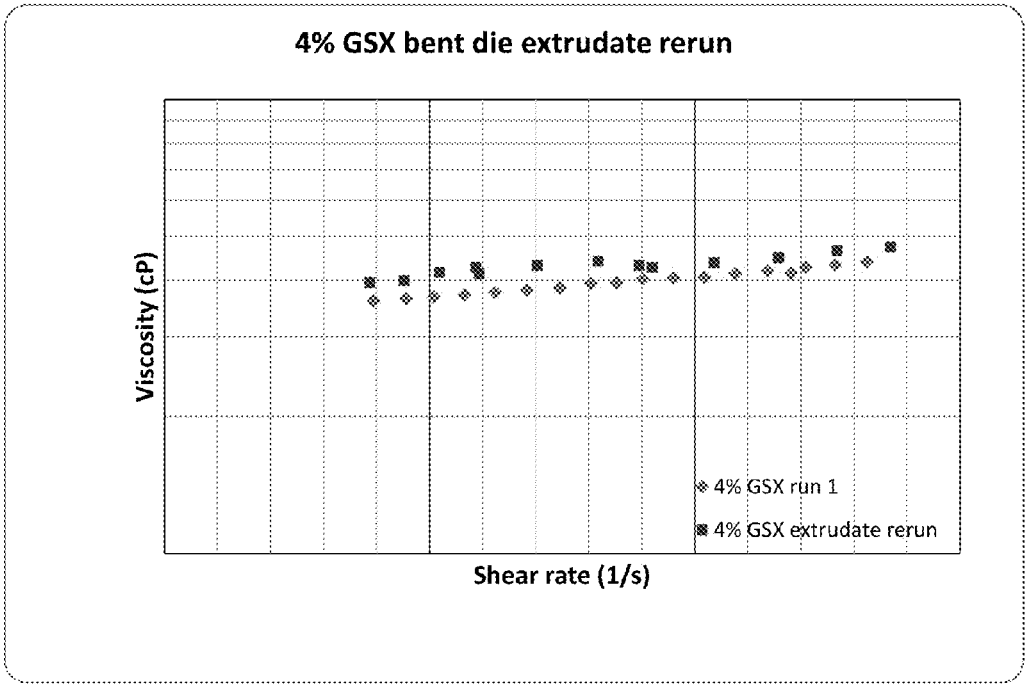
FIG. 5 shows viscosity data at 100° C. obtained when crude oil containing 4% of the blend of turpentine liquids (labeled 4% GSX) was run through a 90° bent die in the shear rate range that encompassed the Reynolds number in the range of 1,500-4,000.
Figure 6:
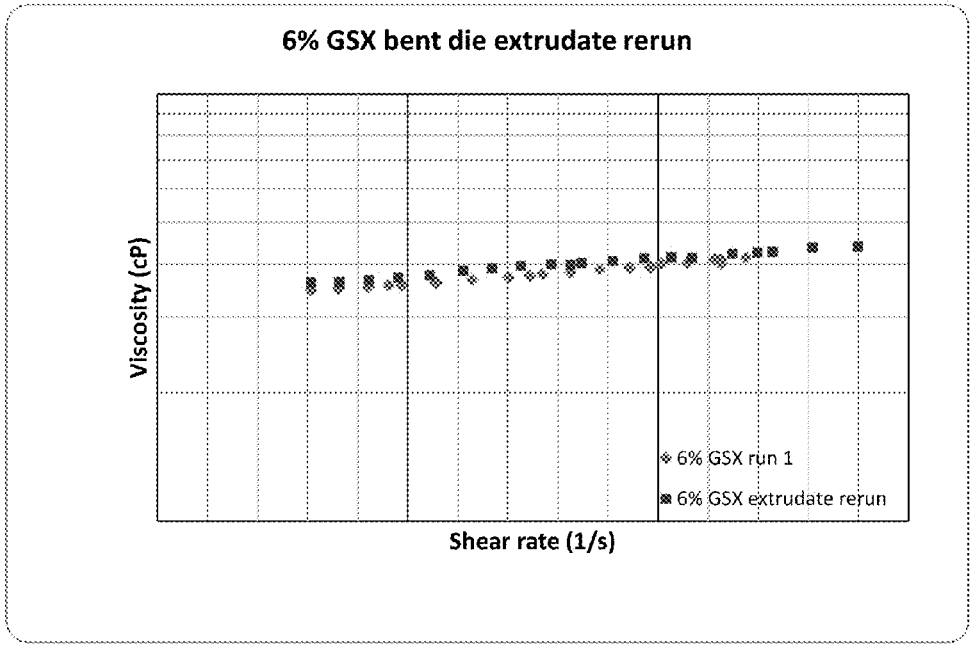
FIG. 6 shows viscosity data at 100° C. obtained when crude oil containing 6% of the blend of turpentine liquids (labeled 6% GSX) was run through a 90° bent die in the shear rate range that encompassed the Reynolds number in the range of 1,500-4,000.
Figure 7:
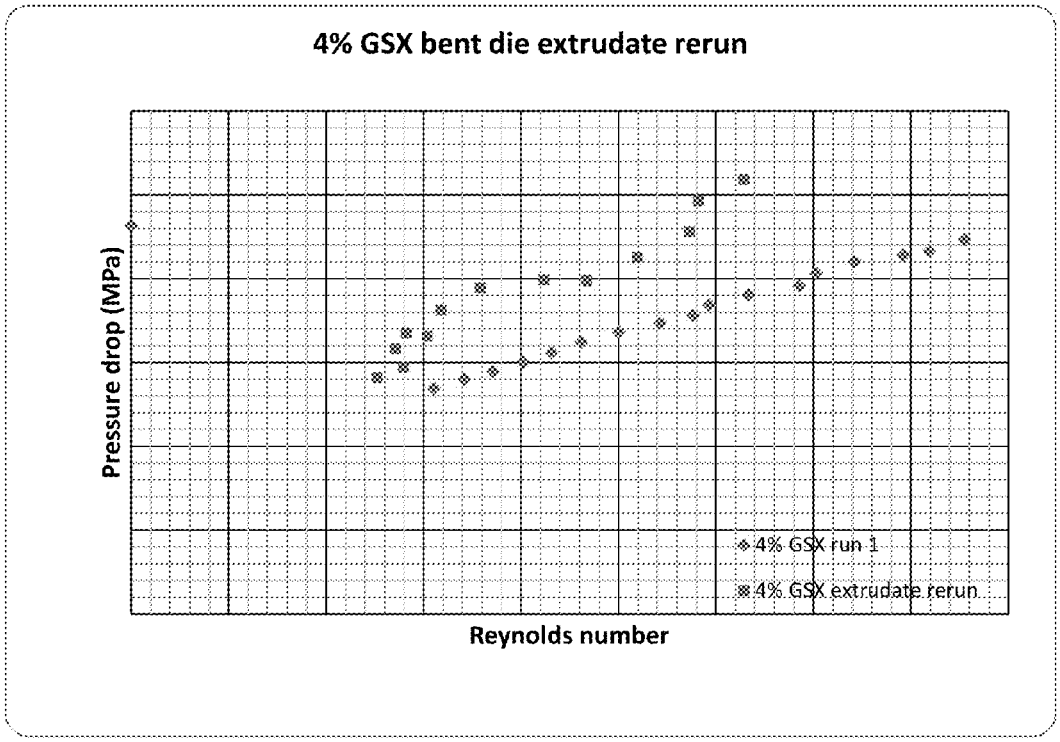
FIG. 7 demonstrates the effect of high shear rate on the structure of the drag-reducing composition at 4% concentration (labeled 4% GSX) and shows a comparison of pressure profiles of the 4% mixture using a 90° bent die with that of respective extrudates.
Figure 8:
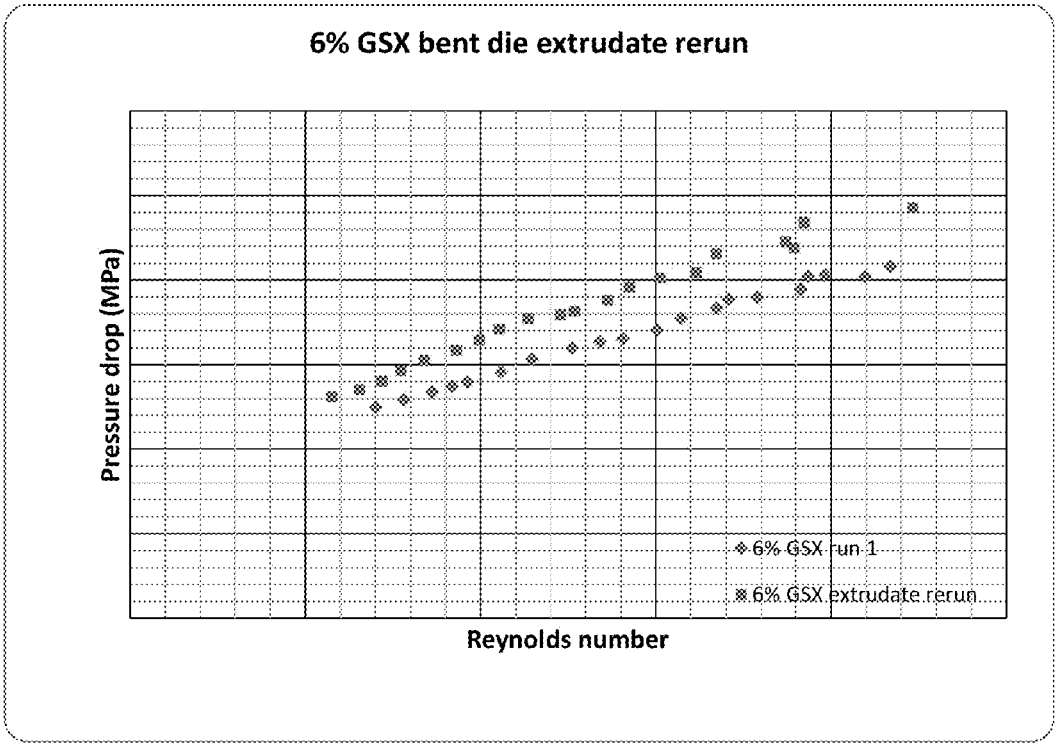
FIG. 8 demonstrates the effect of high shear rate on the structure of the drag-reducing composition at 6% concentration (labeled 6% GSX) and shows a comparison of pressure profiles of the 6% mixture using a 90° bent die with that of respective extrudates.

In FIG. 5 and FIG. 6, only a slight increase in viscosity between the first run of the sample through the bent die and the recycle run. The recycled crude oil shows a slightly higher viscosity than the original. Accordingly, it was unexpectedly found that the drag-reducing composition of this disclosure can be reused without significant drop-off in performance, which is totally unlike drag-reducing agents that are used by the industry.

The results demonstrated the diluent and drag reducing effects of a blend of turpentine liquids in both the straight die and the die with a 90° elbow. Increasing the concentration of the blend of turpentine liquids in the filtered crude sample reduced the sample viscosity. In addition, the drag reducing effect of the liquid turpentine was accentuated by increasing the Reynolds number, especially in the transition and turbulent flow regions.

While the invention has been shown or described in only some of its embodiments, it should be apparent to those skilled in the art that it is not so limited, but is susceptible to various changes without departing from the scope of the invention.

The invention claimed is:

1. A composition comprising a blend of turpentine liquids in an amount effective for reducing drag, reducing viscosity, and improving flow of a viscous hydrocarbon fluid through a pipeline, wherein said blend of turpentine liquids comprises 40-60% α-terpineol, about 0-10% α-pinene, about 5-20% β-pinene, and about 30-40% p-cymene by volume, wherein said blend of turpentine liquids further comprises a drag reducing polymer, and wherein the composition is not an emulsion and is substantially non-aqueous or non-aqueous.

2. The composition of claim 1, wherein said viscous hydrocarbon fluid is crude oil, bitumen, kerogen, asphaltene, tar, processed refinery products, semi-processed refinery products, diesel, light cycle oil, lube base oil, mineral oil, vacuum gas oil, middle distillate, kerosene, crude oil tank bottoms, vacuum tower bottom product, heavy residues at oil refineries, or a combination thereof.

3. The composition of claim 1, wherein said blend of turpentine liquids further comprises a liquid selected from the group consisting of natural turpentine, synthetic turpentine, mineral turpentine, pine oil, alpha-pinene, beta-pinene, alpha-terpineol, beta-terpineol, gamma-terpineol, 3-carene, anethole, dipentene (p-mentha-1,8-diene), terpene resins, alpha-terpene, beta-terpene, gamma terpene, nopol, pinane, camphene, p-cymene, anisaldehyde, 2-pinane hydroperoxide, 3,7-dimethyl-1,6-octadiene, isobornyl acetate, terpin hydrate, ocimene, 2-pinanol, dihydromyrcenol, isoborneol, alloocimene, alloocimene alcohols, geraniol, 2-methoxy-2,6-dimethyl-7,8-epoxyoctane, camphor, p-menthan-8-ol, alpha-terpinyl acetate, citral, citronellol, 7-methoxydihydrocitronellal, 10-camphorsulphonic acid, p-menthene, p-menthan-8-yl acetate, citronellal, 7-hydroxydihydrocitronellal, menthol, menthone, and polymers thereof.

4. The composition of claim 1, wherein said blend of turpentine liquids consists of a homogeneous one phase blend of four turpentine liquids.

5. The composition of claim 1, further comprising a second liquid added to the blend of turpentine liquids.

6. The composition of claim 5, wherein said second liquid is selected from lower aliphatic alcohols, alkanes, aromatics, aliphatic amines, aromatic amines, carbon bisulfide, at least one solvent manufactured in petroleum refining, and mixtures thereof.

7. The composition of claim 6, wherein said at least one solvent manufactured in petroleum refining is decant oil, light cycle oil and naphtha, solvents manufactured in dry distilling coal, solvents manufactured in fractionating liquefied coal, or a combination thereof.

8. The composition of claim 1, further comprising ethylene glycol.

9. The composition of claim 1, wherein the composition is substantially free of plasticizing agents or free of plasticizing agents.

10. The composition of claim 1, wherein the composition is substantially surfactant-free or surfactant-free.

11. A method of reducing drag, reducing friction, reducing viscosity, and/or improving flow of viscous hydrocarbons in a viscous hydrocarbons storage or pipeline operation, comprising adding an effective amount of a drag-reducing composition containing a blend of turpentine liquids to said viscous hydrocarbons storage or pipeline operation, and forming a drag-reducing mixture of viscous hydrocarbons and the blend of turpentine liquids, wherein said blend of turpentine liquids comprises 40-60% α-terpineol, about 0-10% α-pinene, about 5-20% β-pinene, and about 30-40% p-cymene by volume, further comprising injecting a drag reducing polymer, wherein an emulsion is not formed in any step of said method.

12. The method of claim 11, wherein said viscous hydrocarbon fluid is crude oil, bitumen, kerogen, asphaltene, tar, processed refinery products, semi-processed refinery products, diesel, light cycle oil, lube base oil, mineral oil, vacuum gas oil, middle distillate, kerosene, crude oil tank bottoms, vacuum tower bottom product, heavy residues at oil refineries, or a combination thereof.

13. The method of claim 11, wherein said blend of turpentine liquids further comprises a liquid selected from the group consisting of natural turpentine, synthetic turpentine, mineral turpentine, pine oil, gamma-terpineol, 3-carene, anethole, dipentene (p-mentha-1,8-diene), terpene resins, alpha-terpene, beta-terpene, gamma terpene, nopol, pinane, camphene, anisaldehyde, 2-pinane hydroperoxide, 3,7-dimethyl-1,6-octadiene, isobornyl acetate, terpin hydrate, ocimene, 2-pinanol, dihydromyrcenol, isoborneol, alloocimene, alloocimene alcohols, geraniol, 2-methoxy-2,6-dimethyl-7,8-epoxyoctane, camphor, p-menthan-8-ol, alpha-terpinyl acetate, citral, citronellol, 7-methoxydihydrocitronellal, 10-camphorsulphonic acid, p-menthene, p-menthan-8-yl acetate, citronellal, 7-hydroxydihydrocitronellal, menthol, menthone, and polymers thereof.

14. The method of claim 11, wherein said blend of turpentine liquids consists of a blend of four turpentine liquids.

15. The method of claim 11, further comprising a second liquid added to the blend of turpentine liquids.

16. The method of claim 15, wherein said second liquid is selected from lower aliphatic alcohols, alkanes, aromatics, aliphatic amines, aromatic amines, carbon bisulfide, at least one solvent manufactured in petroleum refining, and mixtures thereof.

17. The method of claim 16, wherein said at least one solvent manufactured in petroleum refining is selected from decant oil, light cycle oil and naphtha, solvents manufactured in dry of a solvent manufactured in distilling coal, a solvent manufactured in fractionating liquefied coal, or a combination thereof.

18. The method of claim 11, further comprising the step of injecting ethylene glycol.

19. The method of claim 11, wherein the composition is substantially free of plasticizing agents or free of plasticizing agents.

20. The method of claim 11, wherein the composition is substantially surfactant-free or surfactant-free.

21. The method of claim 11, wherein the composition is a homogeneous one phase liquid.

22. The method of claim 11, wherein the composition is not an emulsion and is substantially non-aqueous or non-aqueous.

23. The method of claim 11, wherein no plasticizing agents are added during any step of said method.

24. The method of claim 11, wherein no surface-active agents are added during any step of said method.

25. The method of claim 11, wherein no surfactants are added during any step of said method.

26. The method of claim 11, wherein the composition is substantially non-aqueous or non-aqueous.

27. The method of claim 11, wherein the drag-reducing mixture of viscous hydrocarbons and the blend of turpentine liquids that is formed is a homogeneous one-phase liquid.

28. The method of claim 11, wherein the amount of the composition added is an amount effective to reduce drag, reduce viscosity, reduce pressure, and/or improve flow of the viscous hydrocarbon.

29. The method of claim 11, wherein the composition is added in a ratio of about 0.001% to about 20% by weight of said viscous hydrocarbons.

30. The method of claim 11, wherein the composition is added in a ratio of about 0.01% to about 5% by weight of said viscous hydrocarbons.

31. The method of claim 11, wherein the composition is added such that the blend of turpentine liquids in the composition is about 0.001% to about 20% by weight of the viscous hydrocarbons.

32. The method of claim 11, wherein the composition is added such that the blend of turpentine liquids in the composition is between about 0.01% and about 5% by weight of the viscous hydrocarbons.

33. A method of reducing drag, reducing friction, reducing viscosity, and/or improving flow of viscous hydrocarbons in a viscous hydrocarbons storage or pipeline operation, comprising adding an effective amount of a drag-reducing composition containing a blend of turpentine liquids to said viscous hydrocarbons storage or pipeline operation, and forming a drag-reducing mixture of viscous hydrocarbons and the blend of turpentine liquids, wherein said blend of turpentine liquids comprises a blend selected from the group consisting of: about 40-60% α-terpineol, about 30-40% β-terpineol, about 5-20% β-pinene, and about 0-10% p-cymene by volume; about 50% α-terpineol, about 35% β-terpineol, about 10% β-pinene, and about 5% p-cymene by volume; about 50% α-terpineol, about 35% α-pinene, about 10% β-pinene, and about 5% p-cymene by volume; about 40-60% α-terpineol, about 30-40% α-pinene, about 5-20% β-pinene, and about 0-10% p-cymene; and 40-60% α-terpineol, about 0-10% α-pinene, about 5-20% β-pinene, and about 30-40% p-cymene by volume, further comprising injecting a drag reducing polymer, wherein an emulsion is not formed in any step of said method, wherein said adding step comprises adding 0.01% to 4% of the blend of turpentine liquids by weight of the viscous hydrocarbons.

34. The method of claim 11, wherein the ratio of the blend of turpentine liquids to any other drag-reducing additive contained in the composition is greater than or equal to about 1:1 by volume.

35. The method of claim 34, wherein the ratio of the blend of turpentine liquids to any other drag-reducing additive contained in the composition is greater than or equal to about 4:1 by volume.

* * * * *